US012098051B2

(12) United States Patent
Ogata et al.

(10) Patent No.: US 12,098,051 B2
(45) Date of Patent: Sep. 24, 2024

(54) IMAGE FORMING APPARATUS, PRINTING METHOD, AND COMPUTER-READABLE RECORDING MEDIUM THAT HAS STORED CONTROL PROGRAM

(71) Applicant: KONICA MINOLTA, INC., Tokyo (JP)

(72) Inventors: Satoshi Ogata, Hachioji (JP); Yumiko Izumiya, Hachioji (JP); Kazutoshi Yoshimura, Hino (JP); Hiroyuki Maruyama, Toyokawa (JP); Masashi Sugano, Hachioji (JP); Tsuyoshi Yoneyama, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 203 days.

(21) Appl. No.: 17/455,115

(22) Filed: Nov. 16, 2021

(65) Prior Publication Data

US 2022/0177257 A1 Jun. 9, 2022

(30) Foreign Application Priority Data

Dec. 8, 2020 (JP) ..... 2020-203424

(51) Int. Cl.
*B65H 43/08* (2006.01)
*B65H 29/60* (2006.01)
*G03G 15/00* (2006.01)

(52) U.S. Cl.
CPC ..... *B65H 43/08* (2013.01); *B65H 29/60* (2013.01); *B65H 2511/13* (2013.01);
(Continued)

(58) Field of Classification Search
CPC ..... G03G 15/5029; G03G 2215/00751; G03G 2215/00738; B41J 11/0035; B41J 11/009;
(Continued)

(56) References Cited

U.S. PATENT DOCUMENTS 8,085,411 B2 12/2011 Kai et al.
2001/0026293 A1* 10/2001 Kaneko ..... B41J 13/0054 347/14
2016/0154356 A1* 6/2016 Goto ..... G01N 21/86 399/45

FOREIGN PATENT DOCUMENTS

JP 2005-062916 A 3/2005
JP 2020104266 A 7/2020

OTHER PUBLICATIONS

Office Action issued in Japanese Application No. 2020-203424; Dated Apr. 2, 2024 (10 pages).

* cited by examiner

*Primary Examiner* — Luis A Gonzalez
(74) *Attorney, Agent, or Firm* — Osha Bergman Watanabe & Burton LLP

(57) ABSTRACT

An image forming apparatus includes a sensor that acquires first and second data groups of paper characteristics by measuring a recording medium; a processor that determines a parameter for controlling at least one of image formation and conveyance of a recording medium on a conveyance path based on the first and second data groups acquired by the sensor; an image former that forms an image on a recording medium conveyed on the conveyance path based on the parameter. The processor compares the first and second paper characteristic data groups, the first paper characteristic data group has been measured at a first time period and the second paper characteristic data group has been measured at a second time period nearer to a present time than the first time period, and the processor controls the image formation based on a the comparison result.

21 Claims, 10 Drawing Sheets

(52) U.S. Cl.
CPC .... *B65H 2511/135* (2013.01); *B65H 2553/27* (2013.01); *B65H 2557/242* (2013.01); *B65H 2801/06* (2013.01)

(58) Field of Classification Search
CPC ..... B65H 7/06; B65H 2511/13; B65H 2511/135; B65H 2557/64; B65H 2557/242; B65H 2553/27; B65H 29/60
See application file for complete search history.

FIG.9

| ID | | Paper characteristic data group | | | | | Additional information | |
|---|---|---|---|---|---|---|---|---|
| No. | Registered name | Paper characteristic 1 "surface nature 1" | Paper characteristic 2 "surface nature 2" | Paper characteristic 3 "paper thickness" | Paper characteristic 4 "basic weight" | Paper characteristic 5 "moisture content" | Measurement date | Sensor unit |
| 1 | x01 | Output** | Output** | Output** | Output** | Output** | 7/1 15:00 | External unit01 |
| ..... | ..... | ..... | ..... | ..... | ..... | ..... | ..... | ..... |

FIG.10A

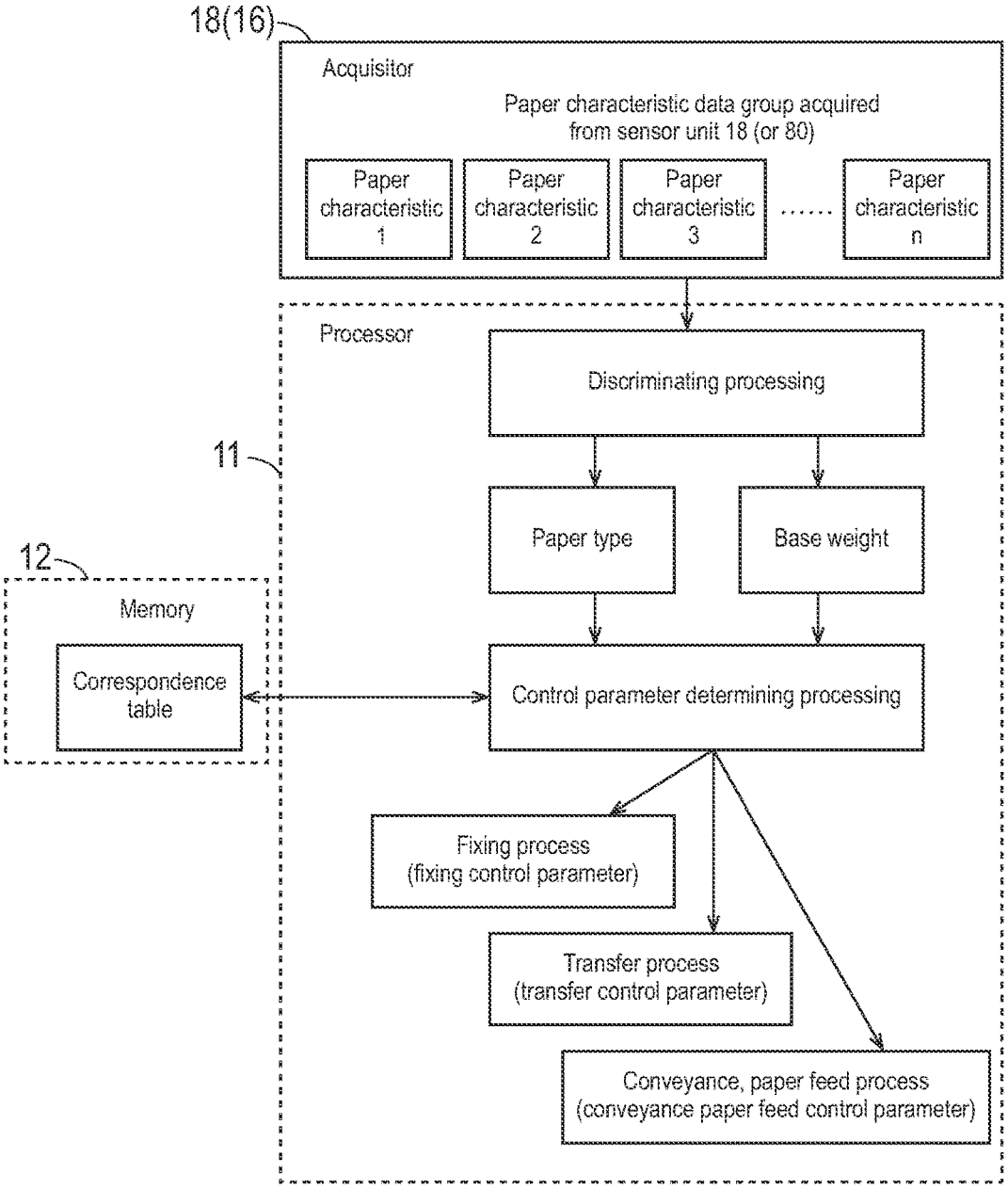

FIG. 12

| ID | | Paper characteristic data group | | | | | Additional information | | | |
|---|---|---|---|---|---|---|---|---|---|---|
| No. | Registered name | Paper characteristic 1 "surface nature 1" | Paper characteristic 2 "surface nature 2" | Paper characteristic 3 "paper thickness" | Paper characteristic 4 "basic weight" | Paper characteristic 5 "moisture content" | Accuracy index | Measurement date | Environment information at the time of measurement | Sensor unit |
| 1 | x01 | Output** | Output** | Output** | Output** | Output** | L3(high) | 7/1 15:00 | 20°C/50%RH | External unit01 |
| ..... | ..... | ..... | ..... | ..... | ..... | ..... | ..... | ..... | ..... | ..... |

IMAGE FORMING APPARATUS, PRINTING METHOD, AND COMPUTER-READABLE RECORDING MEDIUM THAT HAS STORED CONTROL PROGRAM

CROSS-REFERENCE TO RELATED APPLICATION

The entire disclosure of Japanese patent application No. 2020-203424, filed on Dec. 8, 2020, is incorporated herein by reference.

BACKGROUND

1. Technical Field

The present invention relates to an image forming apparatus, a printing method, and a computer readable recording medium that has stored a control program.

2. Description of Related Arts

In recent years, in color printing industries, image forming apparatuses, such as a printer of an electro-photographing system, have been being utilized widely. In the field of PP (production print) corresponding to color printing industries, adaptation to various types of paper has been required as compared with a case of being used in an office, (herein, in this specification, "a sheet of paper" or "a sheet-shaped paper" is merely referred to as "a paper"). Then, in order to perform printing with high quality to these various papers, the kind of a paper stored in a paper feed tray is set up, and the printing is performed on the basis of a printing condition determined in accordance with the setting.

For example, a printer disclosed in Patent Literature 1 (Japanese Unexamined Patent Publication No. 2005-62916) is configured to use a sensor referred to as a media sensor to discriminate the kind of a paper automatically and to perform printing on the basis of a printing condition corresponding to the automatically-detected kind of a paper. Moreover, this printer aims to avoid executing of printing to cause printing failure due to mismatching between media to be fed and media having been set up. Accordingly, in the case where the media information (paper-kind information) having been acquired at a first timing to output printing data, differs from the media information having been acquired at a second timing such as a timing of printing setting before the first timing, warning is issued. Alternatively, in the case where there is no proper media, printing data on the basis of a regular paper is output.

However, in the printer of the Patent Literature 1, the kind of a paper is classified on the basis of the detected measurement data, and, depending on whether or not the kinds of media obtained at the first and second timings after the classifying coincide with the classified kind, it is determined whether correct media is used. The measurement data obtained by measuring a paper with a media sensor is not taken only from a paper on the center of a division but also from a paper near a boundary of the division. In such a case, even if a difference between measurement data obtained at the first and second timings is small, the measurement data may be classified into respective different division. As a result, even if papers are the same paper, the papers would be discriminated as different paper kinds.

SUMMARY

One or more embodiments of the present invention provide an image forming apparatus that can discriminate, with high precision, mismatching between print setting and a paper to be used due to setting error or loading error in the loading of papers to be used into a paper feed tray and can prevent lowering of print quality due to the mismatching before any trouble occur.

An image forming apparatus of one or more embodiments includes a processor that determines a control parameter with regard to image formation and/or conveyance of a recording medium in the apparatus on a basis of the paper characteristic data group acquired by an acquisitor (i.e., a sensor unit or sensor); and an image former that performs image formation for a recording medium conveyed on a conveyance path in the apparatus on a basis of the control parameter determined by the processor, wherein the processor compares a first paper characteristic data group and a second paper characteristic data group each acquired by the acquisitor, in which the first paper characteristic data group has been measured at a first time period and a second paper characteristic data group has been measured at a second time period nearer in time series than the first time period, and executes a control operation with regard to image formation on a basis of the comparison result.

Moreover, a printing method of one or more embodiments includes (a) acquiring a paper characteristic data group including a plurality of paper characteristics obtained by measuring a recording medium; (b) determining a control parameter with regard to image formation and/or conveyance of a recording medium in an apparatus on a basis of the paper characteristic data group acquired in (a); (c) performing image formation for a recording medium conveyed on a conveyance path in the apparatus on a basis of the control parameter determined in (b); and (d) comparing a first paper characteristic data group and a second paper characteristic data group each acquired in (a), wherein the first paper characteristic data group is measured at a first time period and the second paper characteristic data group is measured at s second time period nearer in time series than the first time period, and executing a control operation on a basis of the comparison result.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 9 is an example of a data format of a paper characteristic data group.

FIG. 10A is a block diagram showing processing to determine control parameters on the basis of paper characteristics in the first example.

FIG. 12 is an example of a data format of a paper characteristic data group.

DETAILED DESCRIPTION OF EMBODIMENTS

Figure 1:
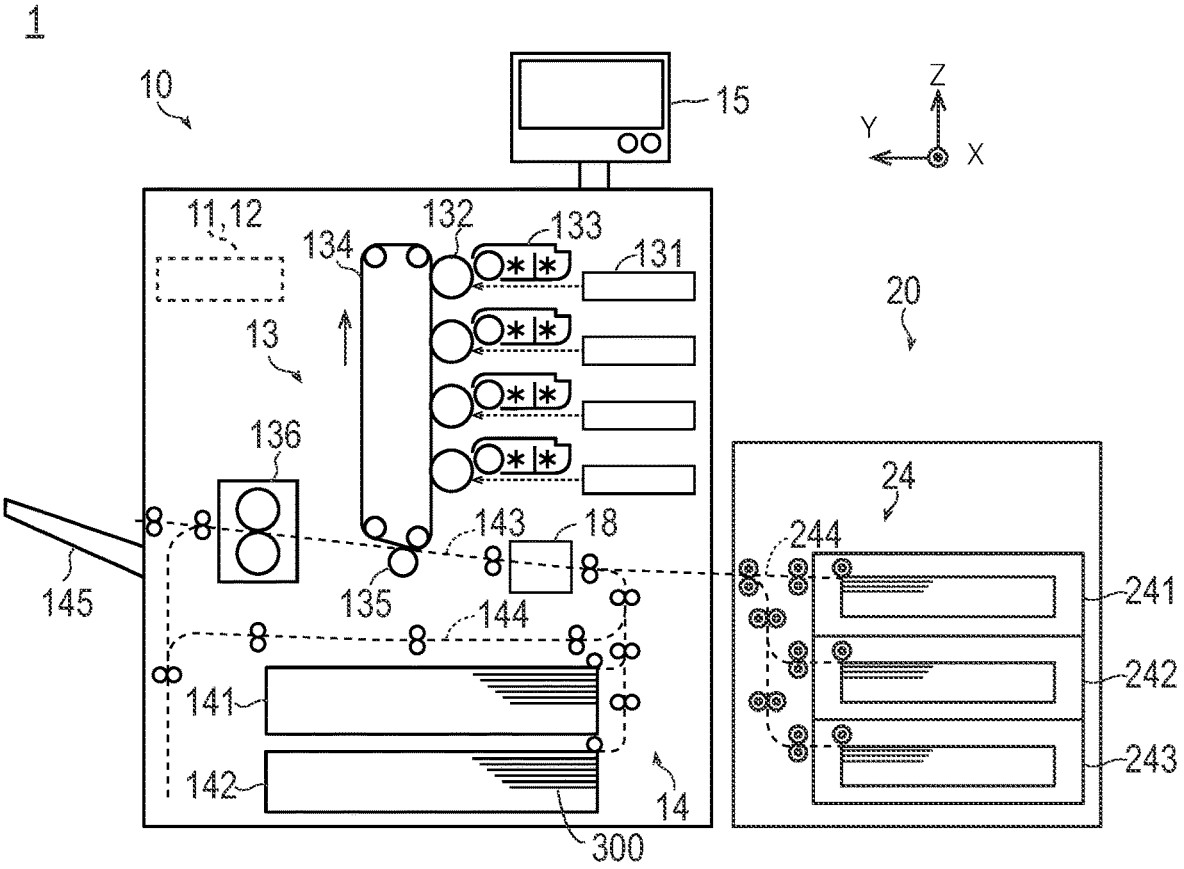
FIG. 1 is a drawing showing a schematic configuration of an image forming apparatus according to the present embodiment.

Hereinafter, with reference to attached drawings, embodiments of the present invention will be described. However, the scope of the invention is not limited to the disclosed embodiments. In this connection, in the description for the drawings, the same constitutional element is provided with the same reference symbol, and the overlapping description is omitted. Moreover, dimensional ratios in the drawings are exaggerated on account of description and may be different from the actual ratios. In the drawings, an up-and-down direction is referred to as a Z direction, a front face to back face direction in an image forming apparatus is referred to as a X direction, and a direction orthogonal to each of these X and Z directions is referred to as a Y direction. The X direction is also referred to as a width direction. In the present embodiment, in a recording medium, a print paper and various films are included. In particular, as a print paper, those produced by using plant-derived mechanical pulp and/or chemical pulp are included. Moreover, as a kind of recording medium, a gross paper, mat paper, regular paper, high gloss paper, etc. are included. Hereinafter, the recording medium is simply referred to as a paper.

Figure 2:
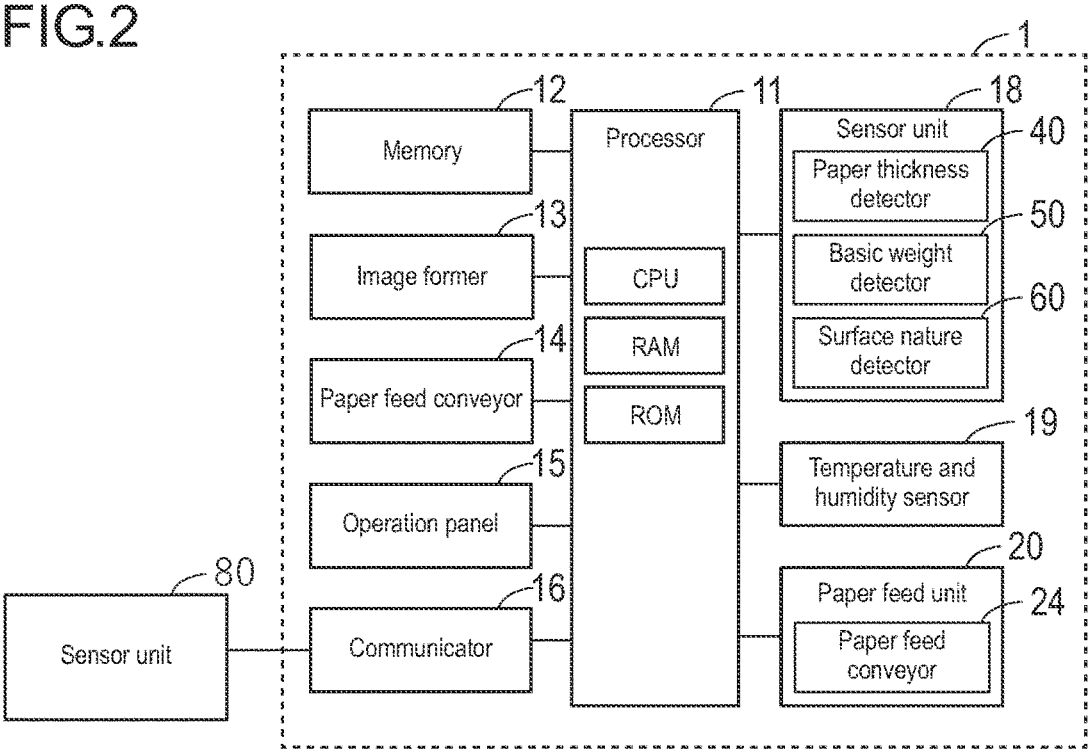
FIG. 2 is a block diagram showing a configuration of the image forming apparatus.

FIG. 1 is a drawing showing a schematic configuration of an image forming apparatus 1 including a sensor unit (sensor) 18 in an apparatus. FIG. 2 is a block diagram showing a configuration of the image forming apparatus 1. As shown in FIG. 1, the image forming apparatus includes an image forming apparatus main body 10 and a paper feed unit 20 that are mechanically and electrically mutually connected to be able to communicate with each other.

(Image Forming Apparatus Main Body 10)

As shown in FIG. 2, the image forming apparatus main body 10 includes a processor 11, a memory 12, an image former 13, a paper feed conveyor 14, an operation panel 15, a communicator 16, a sensor unit 18, a temperature and humidity sensor 19, and so on. These components are connected to each other through signal lines, such as a bus for exchanging signals.

Figure 3:
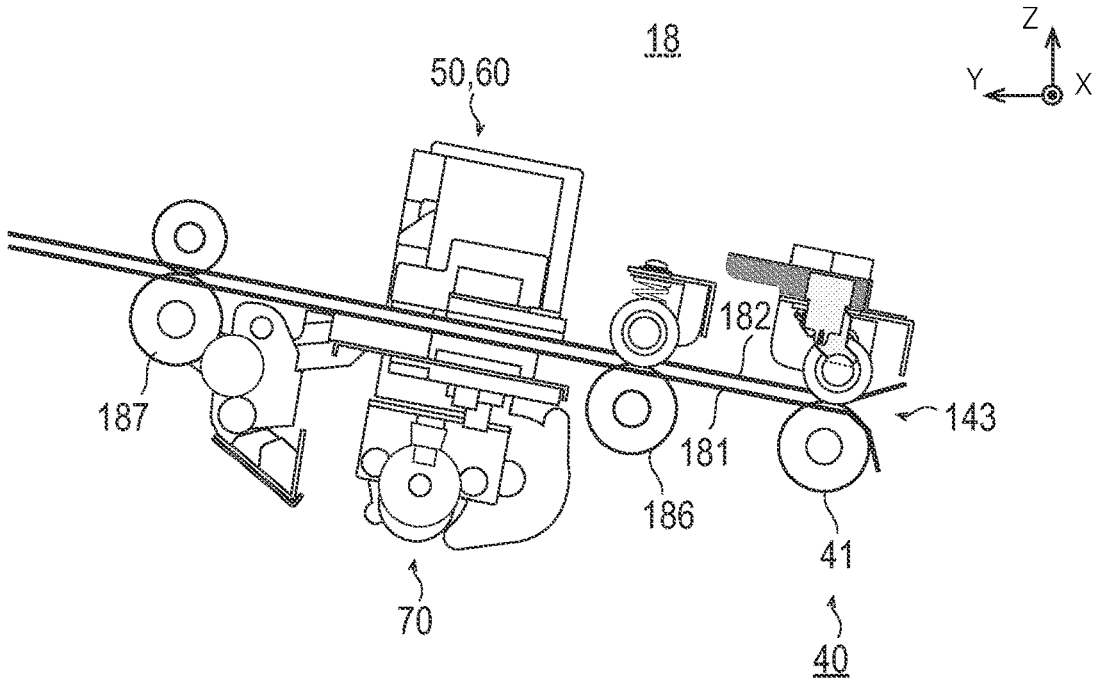
FIG. 3 is a side view of a periphery of a sensor unit (sensor) disposed in the apparatus.

FIG. 3 is a side view showing a configuration of the sensor unit 18 disposed on a conveyance path 143. The sensor unit 18 is also referred to as a media sensor, includes a paper thickness detector 40, a basic weight detector 50, a surface nature detector 60, and a paper pressing mechanism 70, and measures a plurality of paper characteristics (referred to as multiple paper characteristics). This basic weight detector 50 is a first optical sensor of a transmission type and the surface nature detector 60 is a second optical sensor of a reflection type. When detecting paper characteristics by the surface nature detector 60, the paper pressing mechanism 70 presses down a paper. The details of the sensor unit 18 will be mentioned later.

(Processor 11)

The processor 11 includes a CPU, a ROM, a RAM, etc., executes various kinds of processing by executing programs stored in the ROM and a below-mentioned memory 12, and performs control for each unit of the apparatus and various kinds of arithmetic processing in accordance with programs.

(Memory 12)

The memory 12 includes an auxiliary memory, such as a hard disk that stores various programs and various kinds of data beforehand. Moreover, the memory 12 memorizes information on a paper being stored in each of paper feed trays. As the paper information, included are information with regard to a brand, size (paper width and paper length), basic weight (weight), and kind (coated paper, regular paper, high quality paper, rough paper, etc.) of a paper, and the paper information is set by paper kind determining processing (refer to below-mentioned FIG. 10A etc.). Moreover, it is permissible that the memory 12 memorizes a learned model used for determining a brand of a paper or a kind of a paper and a paper profile (each of them will be mentioned later).

(Image Former 13)

The image former 13 forms an image by, for example, an electro-photographing method. As shown in FIG. 1, the image former 13 includes writers 131 corresponding to respective basic colors of Y (yellow), M (magenta), C (cyanogen), and K (black), photoconductor drums 132, and developers 133 each of which stores one of two-component developing agents each including toner of one of the basic colors and carrier. Moreover, the image former 13 further includes an intermediate transfer belt 134, a secondary transferer 135, and a fixer 136. Toner images formed on the photoconductor drums 132 by the respective developers 133 of the basic colors are superimposed on each other on the intermediate transfer belt 134, and then, the superimposed toner images are transferred onto a paper 300 conveyed to the secondary transferer 135. The superimposed toner images on the paper 300 are heated and pressurized by the fixer 136 on the downstream side, whereby the superimposed toner images are fixed as a color image on the paper 300.

(Paper Feed Conveyor 14)

The paper feed conveyor 14 includes a plurality of paper feed trays 141 and 142, conveyance paths 143 and 144, and the like. The conveyance paths 143 and 144 include a plurality of conveyance roller pairs disposed along these conveyance paths and a drive motor (not shown) that drives these conveyance roller pairs. The paper feed conveyor 14 further includes convey-out rollers each of which is disposed in one of the paper feed trays 141 and 142 and conveys out a paper positioned at a top among a plurality of papers 300 loaded in the corresponding one of the paper feed trays 141 and 142, whereby the convey-out roller conveys out the papers 300 in the paper feed tray one sheet by one sheet to the conveyance path on the downstream side. On the upstream side of a registration roller on the conveyance path 143, there is provided a sensor unit 18. As shown in FIG. 2, in the vicinity of the sensor unit 18, the conveyance path 143 is formed between guides configured by metal plates opposite to each other with a predetermined interval. The guides include guide plates 181 and 182 (refer to FIG. 3). On the conveyance path 143, a paper 300 passes.

The paper feed conveyor 14 conveys a paper 300 fed out from the paper feed tray 141 and so on. In the case of performing double-sided printing that further forms an image on a reverse surface of a paper 300, the paper feed conveyor 14 conveys a paper 300 with an obverse surface on which an image has been formed, to a conveyance path 144 that is located on a lower portion of an apparatus main body and used for double-sided image formation. A paper 300 having been conveyed to this conveyance path 144 is subjected to an obverse/reverse surface reversing process on a switchback route. After obverse/reverse surfaces of the paper 300 are reversed on the switchback route, the paper 300 is conveyed so as to join the conveyance flow of the conveyance path 143 so that an image is formed on the reverse surface of the paper 300 by the image former 13. The paper 300 onto which image formation has been performed is discharged onto a paper delivery tray 145.

(Operation Panel 15)

The operation panel 15 includes a touch panel, a ten key, a start button, a stop button, and the like, displays a state of the image forming apparatus main body 10 or the image forming apparatus 1, and is used for setting the kind of a paper loaded in the paper feed tray 141 and inputting an instruction by a user.

(Communicator 16)

The communicator 16 communicates with other external devices, such as an external sensor unit (sensor) 80 and a PC terminal by a USB cable, a wired LAN (Local Area Network), a wireless LAN (for example, LAN conforming to IEEE802.11 standard), and so on.

(Sensor Unit 18)

The sensor unit 18 functions as an acquisitor and acquires a paper characteristic data group including a plurality of paper characteristics obtained by measuring one recording medium. The paper characteristics as measurement results include a paper thickness, a basic weight, surface natures 1 and 2, a moisture content, and the like, as described in the below.

As mentioned above, the sensor unit 18 includes the paper thickness detector 40, the basic weight detector 50, the surface nature detector 60, and the paper pressing mechanism 70. As shown in FIG. 3, among these configuration components, on the upstream side of the conveyance direction, there is provided the paper thickness detector 40, and on the downstream side, there are provided the basic weight detector 50, the surface nature detector 60, and the paper pressing mechanism 70. The basic weight detector 50 and the surface nature detector 60 are disposed side by side along a width direction (an X direction) at the same position in the conveyance direction. For example, the basic weight detector 50 is disposed on the front side, and the surface nature detector 60 are disposed on the back side. On an upper side of the conveyance path 143, the surface nature detector 60 is disposed, and on a lower side, the paper pressing mechanism 70 is disposed so as to oppose to the surface nature detector 60. On the conveyance path 143, there are provided the conveyance roller pairs 41, 186, and 187 sequentially from the upstream side.

(Paper Thickness Detector 40)

When a paper 300 is conveyed to a nipped portion between the conveyance roller pair 41, a shaft position of a driven roller of the conveyance roller pair 41 is displaced correspondingly to the thickness of the paper 300. At this time, the paper thickness detector 40 measures the thickness of the paper 300 by measuring the height of this displaced shaft. In the conveyance roller pair 41, a lower-side roller of the two rollers is a fixed drive roller (the shaft center is fixed), and an upper-side roller is a driven roller that is urged separably toward the drive roller. The height of the upper roller is detected by a displacement sensor. The displacement sensor includes an actuator (detection lever) configured to come in contact with an upper roller shaft and an encoder to measure the amount of rotation of this actuator. From the paper thickness detector 40, for example, a paper thickness (micron) is output as a measurement result of paper characteristics (hereinafter, also referred to as a "paper thickness").

(Basic Weight Detector 50)

The basic weight detector 50 is a transmission type optical sensor that detects a physical property value corresponding to the basic weight of a paper 300, includes a light emitting element disposed below the conveyance path 143 and a light receiving element disposed above it, and measures the amount of attenuation (transmittance) of light having penetrated a paper 300. From the basic weight detector 50, for example, the transmittance is output as a measurement result of the paper characteristics (hereinafter, merely referred to as a "basic weight").

(Surface Nature Detector 60)

The surface nature detector 60 includes a housing, a light emitting element, a collimate lens, and a plurality of light receiving elements and as described below, detects optically specularly-reflected light and diffusely-reflected light from the surface of a paper. The upper guide plate 182 is provided with an opening portion (measurement region), and this opening portion becomes an irradiation area of a light receiving element. A paper 300 having been conveyed up to the opening portion is temporarily stopped. The paper 300 is pressed, in the stopped state, from the lower side by the paper pressing mechanism 70 and is subjected to positioning. A reference plane in the opening portion is a virtual plane including an undersurface of the upper guide plate 182, and at the time of measurement, on the reference plane, the surface of the paper 300 that is an object to be measured and has been subjected the positioning, is disposed. An irradiation light flux made to a parallel light flux by a collimate lens is irradiated from the light emitting element with an incident angle of 75 degrees relative to the reference plane. A wavelength of the irradiation light, for example, is 465 nm. The plurality of light receiving elements receive specularly-reflected light and diffusely-reflected light. For example, the light receiving elements are arranged at three places for reflection angles of 30 degrees (for diffusely-reflected light), 60 degrees (for diffusely-reflected light), and 75 degrees (for specularly-reflected light) or at two places for reflection angles of 60 degrees and 75 degrees. From the surface nature detector 60, signals of these light receiving elements are output as a measurement result of the paper characteristics (hereinafter, also referred to as "surface nature 1").

(Paper Pressing Mechanism 70)

This paper pressing mechanism 70 is disposed below the lower guide plate 181. The paper pressing mechanism 70 includes a pressing portion, a drive motor, a cam mechanism, and the like. The top surface of the pressing portion moves upward and downward by the drive of the drive motor and is a flat surface parallel to the lower guide plate 181. At the time of normal paper conveyance, the top surface of the pressing portion is positioned at the same level as the lower guide plate 181. However, at the time of measurement, the top surface of the pressing portion moves upward and pushes a paper 300 against the surface nature detector 60 side. In the state of having pushed the paper 300, the conveyance of the paper 300 is being stopped.

(Other Outputs of Sensor Unit 18)

As mentioned above, a paper thickness, a basic weight, and a surface nature 1 are output as the paper characteristics from the paper thickness detector 40, the basic weight detector 50, and the surface nature detector 60, respectively. However, it may be permissible to output the other paper characteristics from sensors other than these detectors. For example, the sensor unit 18 may include a sensor that outputs a "surface nature 2" and a "moisture content" as measurement results of the paper characteristics. With the "surface nature 2", an index with regard to an amount of depth of the paper 300 is obtained. In concrete terms, light is irradiated to the surface of a paper 300 at a large incident angle (80 degrees or more and less than 90 degrees), and then the surface of the paper 300 in this state is photographed to obtain image data. Successively, the obtained image data is subjected to image processing, whereby an index with regard to an amount of depth corresponding to a concavo-convex state of the surface is output as a measurement result. A "moisture content" can be measured, for example, by a moisture content sensor of a near-infrared system that detects optically the amount of light absorption of OH groups. This water content meter irradiates light of a predetermined wavelength of a near-infrared region to a paper 300 and utilizes the property that the absorption factor of light changes according to the moisture content of the paper 300. From the water content meter, for example, a moisture content is output as a measurement result of the paper characteristics.

(Temperature and Humidity Sensor 19)

The temperature and humidity sensor 19 includes a temperature sensor and a humidity sensor and measures the temperature and humidity in the vicinity of an apparatus.

(Paper Feed Unit 20)

As shown in FIG. 1, the paper feed unit 20 includes the paper feed conveyor 24. Moreover, the paper feed unit 20 includes, in addition to the paper feed conveyor 24, a processor, memory, and a communicator that communicates with the image forming apparatus main body 10 (neither is illustrated), and these units are connected to each other through signal lines, such as a bus, for exchanging signals. The paper feed conveyor 24 includes a plurality of paper feed trays 241, 242, and 243 and a conveyance path 244. A paper 300 conveyed from each of the paper feed trays is conveyed to the image forming apparatus main body 10 on the downstream side and is subjected to measurement of the paper characteristics in the sensor unit 18, or to image formation in the image former 13.

(External Sensor Unit 80)

Figure 4A:
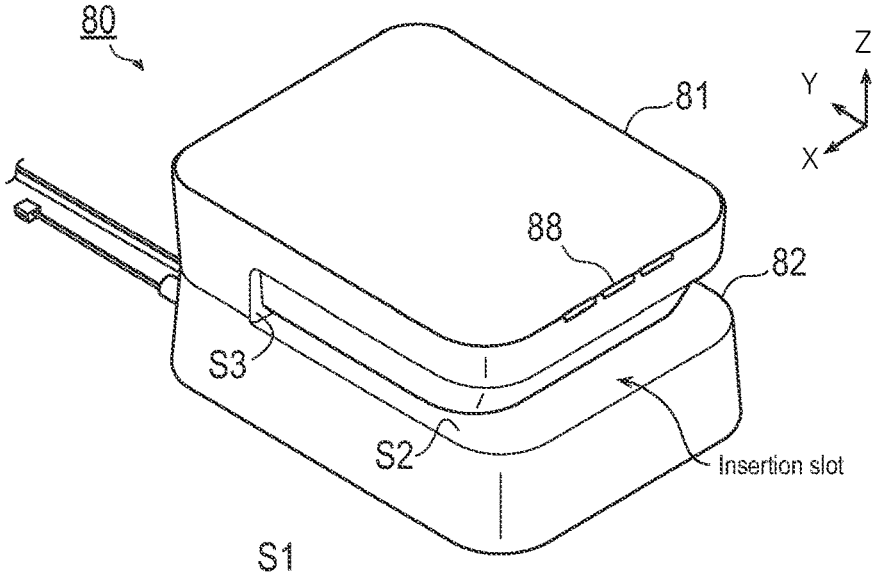
FIG. 4A is a perspective view showing an appearance of an external sensor unit (sensor)
Figure 4B:
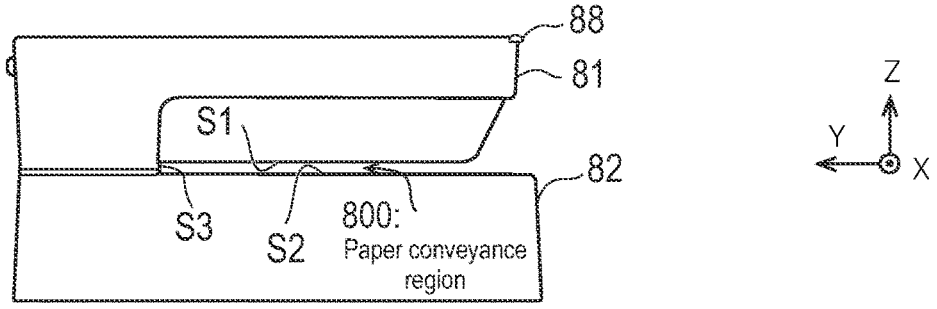
FIG. 4B is a side view of it.
Figure 5A:
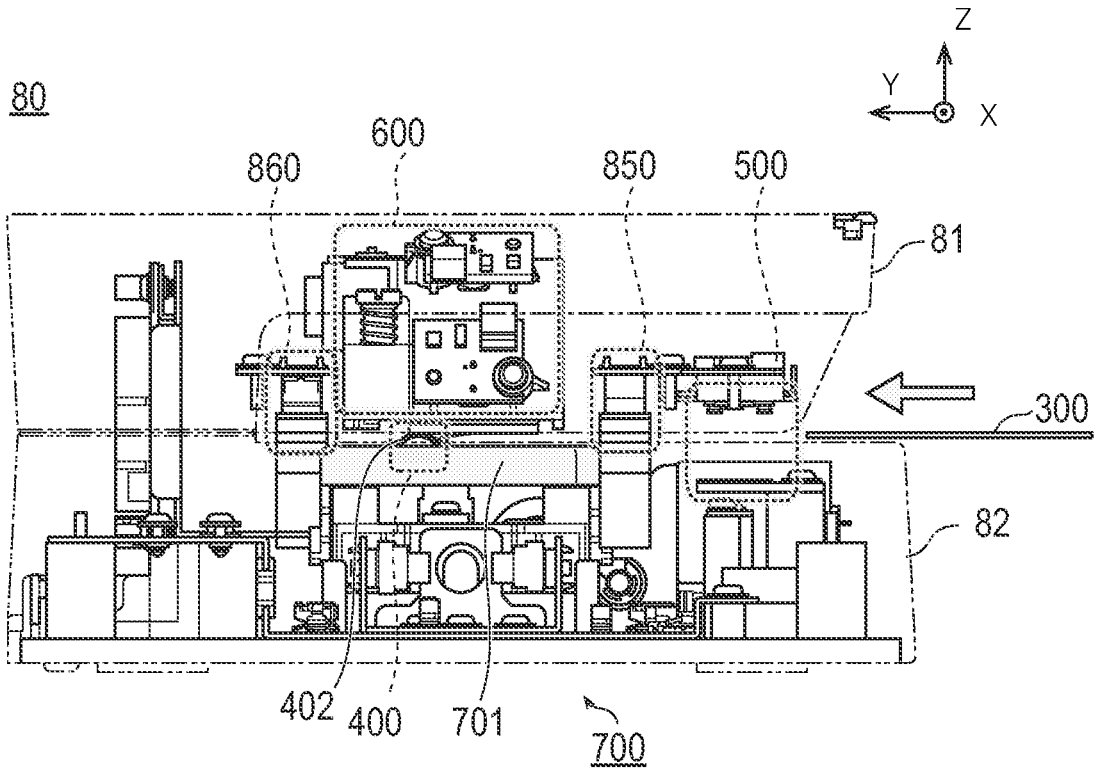
FIG. 5A is a cross sectional view of the external sensor unit.
Figure 5B:
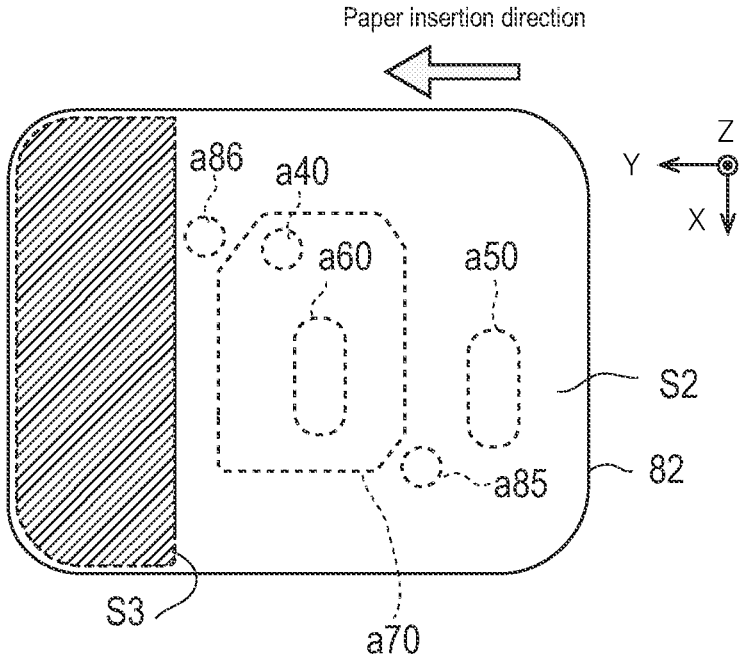
FIG. 5B is a schematic top view showing a detection region and the like on a lower housing.

FIG. 4A is a perspective view, FIG. 4B is a side view, and each of FIG. 4A and FIG. 4B shows an appearance of the external sensor unit 80. FIG. 5A is a side view showing an internal configuration of the sensor unit 80, and FIG. 5B is a schematic top view showing a detection region etc. in the lower housing 82 of the sensor unit 80. The sensor unit 80 of off-line has a function similar to that of the above-mentioned sensor unit 18 in the apparatus (in-line) and measures a plurality of paper characteristics. In the case of measuring the plurality of paper characteristics of a paper by using this external sensor unit 80, the communicator 16 that transmits and receives a paper characteristic data group from this sensor unit 80 functions as an acquisitor.

As shown in FIGS. 4A-4B, the sensor unit 80 includes the upper housing 81 and the lower housing 82. At the top front of the sensor unit 80, there is disposed an LED display 88 for indicating a state of an apparatus depending on whether light is turned on or off. The top surface of the lower housing 82 is a placement surface S2 on which a paper 300 to be inserted by a user is placed. At the time of measurement, a user inserts a paper 300 into a paper conveyance region 800 by a hand from an insertion slot. At this time, a paper 300 moves along an insertion direction (a Y direction) while sliding on the placement surface S2, collides with a wall s3 on a back side, and then stops.

As shown in FIG. 5A, in the sensor unit 80, in the order from the insertion slot toward the back side, a basic weight detector 500, a first media set sensor 850, a surface nature detector 600, a paper thickness detector 400, and a second media set sensor 860 are disposed. Moreover, the paper thickness detector 400 is mounted on a pressing plate 701 of a paper pressing mechanism 700 and moves with the up-and-down movement of the pressing plate 701. This pressing plate 701 presses a paper 300 at the time of measurement. Moreover, the sensor unit 80 includes a processor and a memory (not shown) and controls various kinds of operations.

The paper thickness detector 400, the basic weight detector 500, the surface nature detector 600, and the paper pressing mechanism 700 have the respective same functions of the paper thickness detector 40, the basic weight detector 50, the surface nature detector 60, and the paper pressing mechanism 70 of the above-mentioned sensor unit 18 in the apparatus. The first media set sensor 850 and the second media set sensor 860 detect the existence or nonexistence of a paper in the detection region. For example, these sensors are a reflection type sensor and includes a light emitting element that irradiates light towards a detection region (below-mentioned detection region a30) and a light receiving element that receives reflected light from a paper 300. These light emitting element and light receiving element are disposed above the paper conveyance region 200 (upper housing 81).

As shown in FIG. 5B, in the sensor unit 80, in the order from an insertion slot toward the back side, there are disposed a detection region a50 of the basic weight detector 500, a detection region a85 of the first media set sensor 850, a detection region a60 of the surface nature detector 600, a detection region a40 of the paper thickness detector 400, and a detection region a86 of the second media set sensor 860.

Since the basic weight detector 500 and the surface nature detector 600 the same as the basic weight detector 50 and the surface nature detector 60 of the sensor unit 18, respectively, the description for them is omitted. Although the paper pressing mechanism 700 and the paper thickness detector 400 are the same in terms of function as the paper pressing mechanism 70 and the paper thickness detector 40 of the sensor unit 18, they are different in a point of using a contact portion 402 without using rollers (roller pair 41) as follows.

The pressing region a70 corresponds to the pressing surface of the pressing plate 701 of the paper pressing mechanism 700. The pressing plate 701 is provided with an opening portion correspondingly to the detection region a40, and at the inner side of the opening portion, the contact portion 402 of the paper thickness detector 400 is disposed. The contact portion 402 swings within a predetermined range and is urged upward (toward the bottom surface S1). In a state where the pressing plate 701 is lifted up toward the bottom surface S1 of the upper housing 81, the height of the contact portion 402 is detected by a height position sensor at a time when there exists a paper 300 and at a time when there does not exist a paper 300, the thickness of the paper 300 is detected on the basis of a difference (μm) between both heights.

When the first media set sensor 850 on a front side becomes ON (a paper exists), the processor of the sensor unit 80 starts measurement of the paper characteristics by the basic weight detector 500. Successively, when the second media set sensor 860 on a back side becomes ON, the processor of the sensor unit 80 determines that a paper 300 has been set and performs measurement of the paper characteristics by the paper thickness detector 400 and the surface nature detector 600 while holding the paper 300 by the lifted-up pressing plate 701. Then, after measurement has been completed, the pressing plate 701 is lowered, the paper 300 is made free, and measurement of various paper characteristics is ended.

In this way, the sensor unit 80 of off-line has a function similar to that of the above-mentioned sensor unit 18 in the apparatus (in-line) and measures a paper thickness, a basic weight, and a surface nature 1 as the paper characteristics by the paper thickness detector 400, the basic weight detector 500, and the surface nature detector 600, respectively. Moreover, as the other paper characteristics, the sensor unit 80 may be configured so as to be able to measure a surface nature 2 and a moisture content as mentioned above, and by further including a temperature and humidity sensor, the sensor unit 80 may be configured to measure temperature and humidity data.

Printing Processing in First Embodiment

Figure 6:
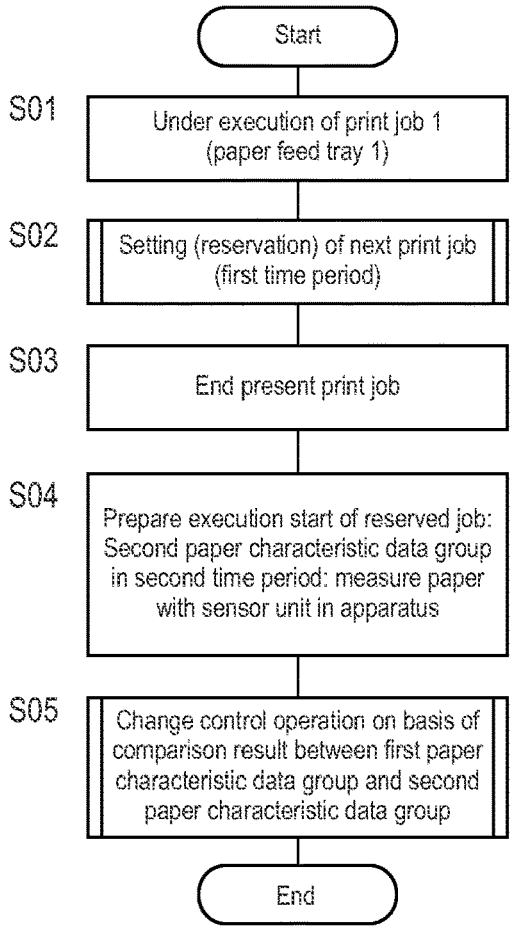
FIG. 6 is a flowchart showing printing processing in the first embodiment.

FIG. 6 is a flowchart showing printing processing in the first embodiment, and this printing processing is executed by the image forming apparatus 1. In this connection, the printing processing of the present embodiment is executed by the image forming apparatus 1 that is used, for example, in a print shop and so on. In the following examples, the second time period to measure the second paper characteristic data group is a timing immediately before actual printing (for example, several minutes to ten and several minutes before), and the first time period to measure the first paper characteristic data group is a timing a little bit before this actual printing.

(Step S01)

Here, the image forming apparatus main body 10 of the image forming apparatus 1 is in the middle of performing a certain print job (print job 1). In this case, the conveyance path 143 is used for printing the print job 1. Accordingly, in the middle of executing, the in-line sensor unit 18 that uses the common conveyance path 143 cannot be used for measurement of other paper. Under such a situation, a user (an employee, an operator, etc.) of a print shop performs paper setting with regard to the next print job by using the off-line sensor unit 80 as described below.

(Step S02)

Figure 7:
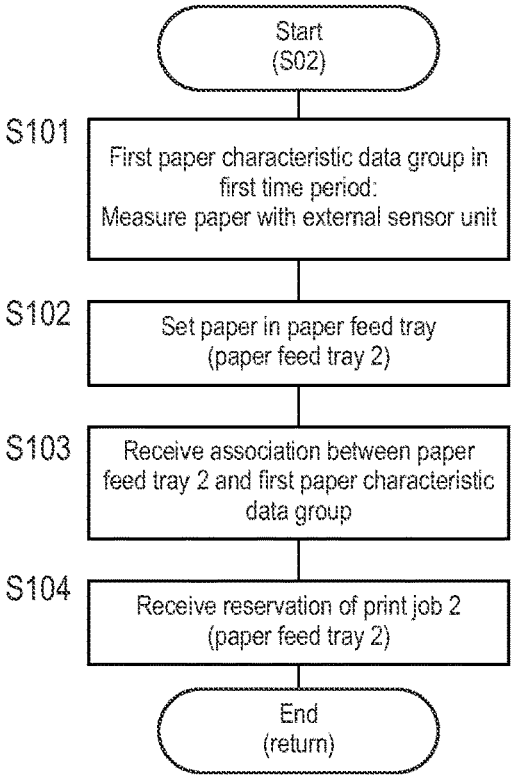
FIG. 7 is a subroutine flowchart showing setting processing (Step S02) of a reserved job.

Here, a user performs reservation setting of the next print job. FIG. 7 is a subroutine flowchart showing the processing in this Step S02.

(Step S101)

As shown in FIG. 7, in here, the processor 11 acquires the first paper characteristic data group at the first time period. For example, a user measures a plurality of paper characteristics of a paper 300 to be used from now by using the external sensor unit 80.

(Step S102)

A user loads (sets) a paper bundle of papers having been subjected to measurement in a paper feed tray (paper tray 2) other than a paper feed tray (for example, paper tray 1) being used in the previous print job 1 in Step S01.

(Step S103)

The processor 11 receives association between papers loaded in the paper feed tray 2 and the first paper characteristic data group acquired in Step S101 through the operation panel 15 etc. by a user. For example, the processor 11 specifies and selects the first paper characteristic data group acquired in Step S101 from a candidate list of a plurality of first paper characteristic data groups memorized in the memory 12 on the basis of identification ID and correlates this with the loaded papers.

(Step S104)

The processor 11 receives reservation of the next print job (print job 2) expected to use the paper feed tray 2 from a user. In this reservation, print data and data of print setting referred as a job ticket are included. With the above processing, the processing of the reservation setting in FIG. 7 is ended (End, Return), and the processing returns to the processing in FIG. 6.

(Step S03)

The processor 11 waits for the ending of the print job 1 being in the middle of execution, and if the print job 1 is ended, the processor 11 advances the processing to Step S04.

(Step S04)

The processor 11 prepares the execution start of the print job 2 whose reservation has been received in Step S02. At this time, the processor 11 acquires the second paper characteristic data group in the second time period in advance to the execution start of a print job. In concrete terms, the paper characteristics of a paper 300 conveyed from the paper feed tray 2 is measured with the sensor unit 18 in the apparatus. This paper 300 is used as a paper for measurement and is not used for actual printing (is discarded).

(Step S05)

Figure 8:
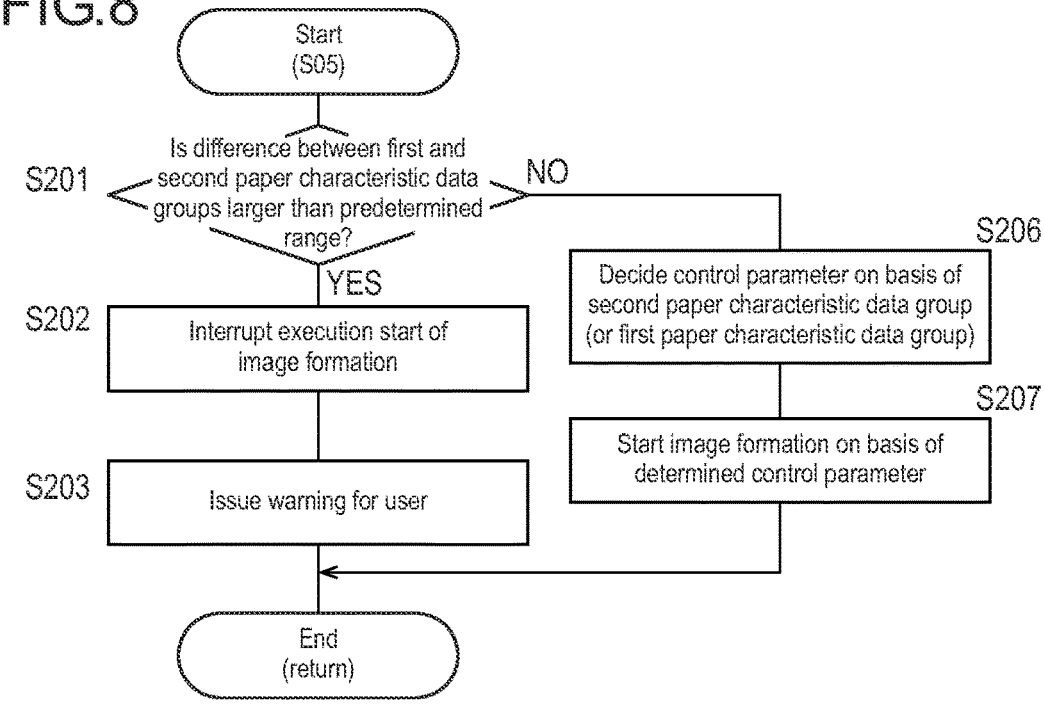
FIG. 8 is a subroutine flowchart showing changing processing (Step S05) of a control operation.

The processor 11 executes a control operation on the basis of a comparison result between the paper characteristic data group in the first time period and the paper characteristic data group in the second time period. Namely, the control operation of a reserved job expected to be performed so far on the basis of the comparison result is changed. FIG. 8 is a subroutine flowchart showing the control operation changing processing in step S05.

(Step S201)

Here, in the case where a difference between the first paper characteristic data group and the second paper characteristic data group is not settled in a predetermined range and larger than the predetermined range (YES), the processor 11 advances the processing to Step S202. On the other hand, in the case where the difference is in the predetermined range (NO), the processor 11 advances the processing to Step S206. With regard to this determination whether or not to be settled in the predetermined range, in the case where a difference between the paper characteristics of even one item of a plurality of paper characteristics is larger than a predetermined value, it is permissible to determine that the difference is not settled in the predetermined range. Alternatively, a point is provided correspondingly to a difference between the first and second paper characteristic data for each item, and in the case where the total of these points exceeds a predetermined value, it may be permissible to determine that the difference is not settled in the predetermined range.

(Step S202)

The processor 11 interrupts the execution start of the prepared print job 2 and does not start image formation.

(Step S203)

The processor 11 notifies a user of warning by displaying a warning sentence through the operation panel 15 and so on.

(Step S206)

The processor 11 selects in advance whether to use which one of the first paper characteristic data group acquired at the first time period in Step S101 and the second paper characteristic data group acquired at the second time period nearer (nearer to the present time) in time series (in terms of time period) than the first time period, in Step S04. This selection is performed in accordance with a defined rule. For example, the processor 11 may select the second paper characteristic data group of the second time period having been selected more later or may select the first paper characteristic data group in accordance with the selection of a user.

Figure 10B:
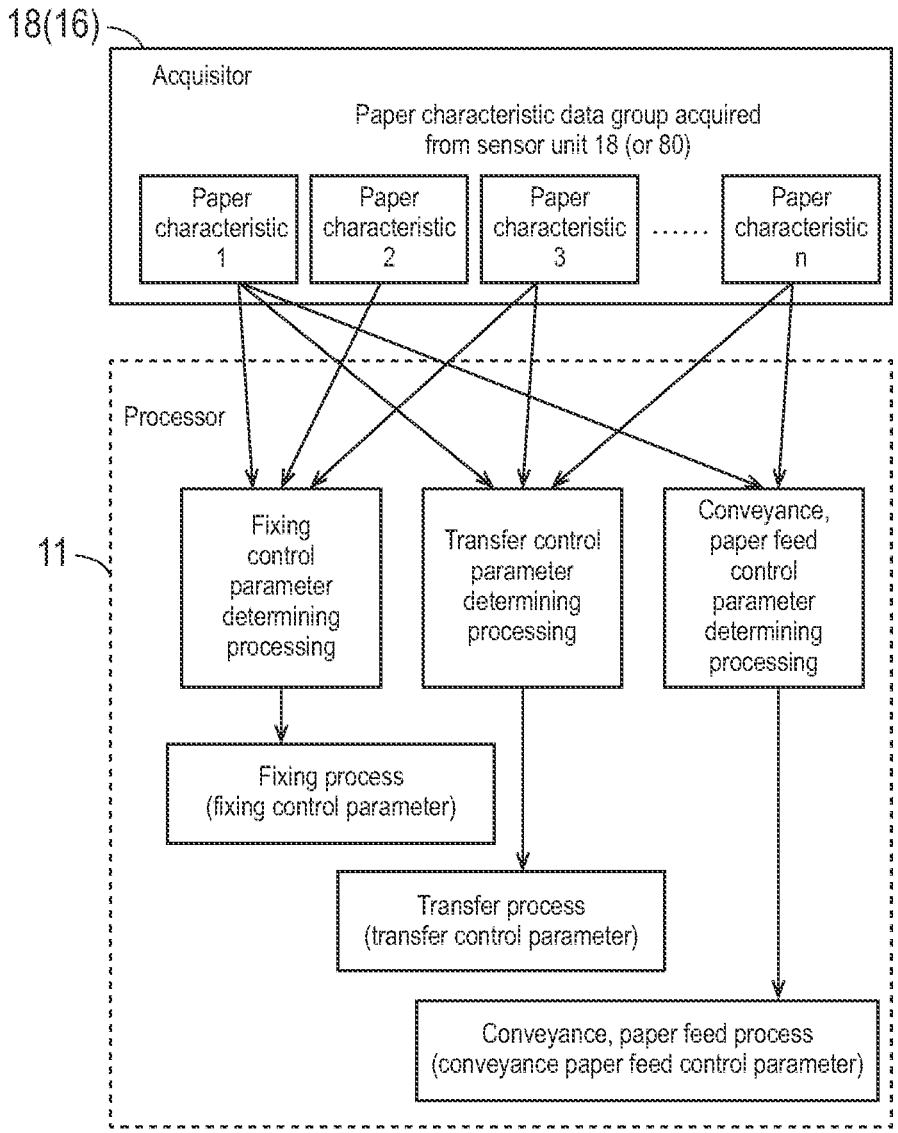
FIG. 10B is a block diagram showing processing to determine control parameters on the basis of paper characteristics in the second example.

Next, the processor 11 determines control parameters on the basis of the selected first or second paper characteristic data group. A determining method of this control parameter will be mentioned later (FIG. 10A, FIG. 10B).

(Step S207)

The processor 11 starts image formation and conveyance on the basis of the control parameter determined in Step S206 and ends them (returns to the processing in FIG. 6 and ends).

(Paper Characteristic Data Group and Control Parameter)

Next, by using from FIG. 9 to FIG. 10B, description will be given to a data format of a paper characteristic data group and the processing for determining control parameters.

FIG. 9 shows one example of a data format of a paper characteristic data group. The paper characteristic data group is usually constituted by a plurality of paper characteristics obtained by performing measurement one time for one sheet of a paper by the sensor unit 18 (or 80) including a plurality of sensors.

As shown in FIG. 9, one paper characteristic data group is provided with an ID and additional information. The ID is provided with a number and a registered name. The registered name may be input by a user or may be provided automatically. Moreover, as additional information, measurement date (the first and second time periods) and an ID number of a sensor unit having been used for the measurement are provided. Moreover, the paper characteristic data group includes a plurality of paper characteristics 1 to n. The examples of the paper characteristics, as mentioned above, include a surface nature 1, a surface nature 2, a paper thickness, a basic weight, a moisture content, and so on.

FIG. 10A is a block diagram showing processing to determine control parameters on the basis of the paper characteristics in the first example. In the first example, the processor 11 discriminates any one of each of a plurality of classified paper kinds and a plurality of classified basic weights by discriminating processing on the basis of the paper characteristics 1 to n. Successively, the processor 11 performs determining processing of control parameters on the basis of the discriminated paper kind and basic weight. When performing this determining processing of parameters, the processor 11 refers a correspondence table that is memorized beforehand in the memory 12 and describes a control value of each of the respective parameters of fixing, transfer, and conveyance for each combination between a paper kind and a basic weight.

The processor 11 controls a fixing process of the fixer 136 and a transferring process of the transferer 135 in the image former 13 on the basis of the determined fixation and transfer control parameters. Moreover, conveyance and paper feed processes of the paper feed conveyor 14 are controlled by determined conveyance and paper feed control parameters.

FIG. 10B is a block diagram showing processing for determining control parameters on the basis of the paper characteristics in the second example. In the first example, the control parameters are determined after having classified once into a paper kind and a basic weight. However, in the second example, each control parameter is directly determined from the paper characteristics. For example, a fixation control parameter is determined on the basis of the paper characteristics 1, 2, and 3, a transfer control parameter is determined on the basis of the paper characteristics 1, 3, and n, and a conveyance and paper feed control parameter is determined on the basis of the paper characteristics 1 and n. In this connection, when determining this control parameter, it may be permissible to use a learned model having been learned with machine learning.

Effect of First Embodiment

In this way, in the first embodiment, the first paper characteristic data group measured at the first time period and the second paper characteristic data group measured at the second time period nearer in time series than the first time period, are compared, and a control operation is executed on the basis of the comparison result. With this, mismatching between a paper set in the print setting and a paper loaded in a paper feed tray due to loading error of a paper to be used onto the paper feed tray, is discriminated precisely, whereby it is possible to prevent a print quality from lowering due to the mismatching, before anything happens. Especially, as compared with the case of comparing paper kinds with each other after having classified the paper kinds, by comparing paper characteristic data groups with each other, it is possible to aim to improve accuracy more.

Printing Processing in Second Embodiment

Figure 11:
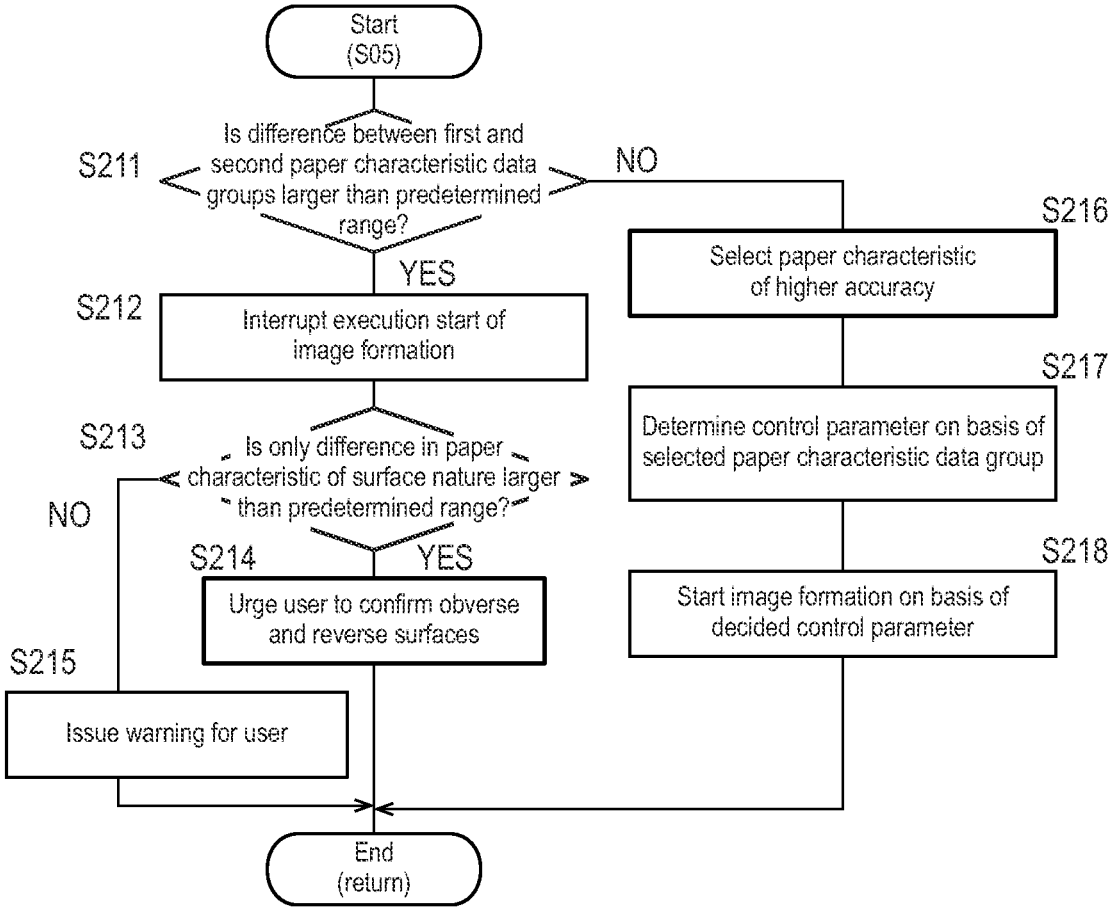
FIG. 11 is a subroutine flowchart showing changing processing (Step S05) of a control operation in the second embodiment.

FIG. 11 is a subroutine flowchart showing the changing processing (Step S05) of a control operation in the printing processing in the second embodiment. In the second embodiment, the processing other than the processing shown in the above drawing (FIG. 11), is the same as the first embodiment. Accordingly, the description for the processing is omitted.

FIG. 12 shows an example of a data format of a paper characteristic data group used by the second embodiment and the below-mentioned third embodiment. Unlike FIG. 9, in the example in FIG. 12, as additional information, an accuracy index and environment information at the time of measurement are further added. In the printing processing in the second embodiment described below, by using this accuracy index, the selection of the paper characteristics data to be used is performed. Moreover, in the second embodiment, in the case of using a paper in which a state of the paper becomes different greatly between obverse and reverse surfaces, the determination of an obverse surface or a reverse surface is performed by using a paper characteristic that indicates the surface state of a paper.

(Steps S211 and S212)

In these Steps S211 and S212, it is determined whether a difference between the first and second paper characteristic data groups is larger than a predetermined range. In the case where it is larger than the predetermined range (YES), the execution start of image formation is interrupted. The processing in each of Step S211 and Step S212 is the same as the processing in each of Step S201 and Step S202 shown in FIG. 8, respectively.

(Step S213)

In here, in the case where the determination as YES in Step S211 has been made by the reason that only a difference between the paper characteristics with regard to a surface nature indicating the surface state of a paper among the paper characteristics included in the first and second paper characteristic data groups, is larger than a predetermined range (YES), the processor 11 advances the processing to Step S214. On the other hand, in the case where a difference between the other paper characteristics is larger than the predetermined range (NO), or in the case where, as result of determining comprehensively, a difference is larger than the predetermined range (NO), the processor 11 advances the processing to Step S215. Here, the paper characteristics of a surface nature is the paper characteristics of the above-mentioned surface nature 1 and/or surface nature 2. For example, in the comparison of the paper characteristics with each other with regard to the surface nature 1 and the surface nature 2 in the first and second paper characteristic data groups, both are larger than a predetermined range, it is determined as yes (YES).

(Step S214)

Since there is a possibility that papers 300 have been loaded in the paper feed tray (paper feed tray 2) by mistake on the obverse and reverse surfaces, the processor 11 issues a notice to urge a user to confirm the obverse and reverse surfaces through the operation panel 15.

(Step S215)

Here, the processor 11 notifies a user of warning similarly to Step S203 in FIG. 8.

(Step S216)

The processor 11 determines whether or not to use which paper characteristic data group among the first and second paper characteristic data groups by using the accuracy information. In concrete terms, the processor 11 refers to the accuracy information as shown in FIG. 12 and the processor 11 selects the paper characteristic data of a group whose accuracy is higher, among the first and second paper characteristic data groups.

Example of Accuracy Index

In an example shown in FIG. 12, accuracy indexes classified into three stages of from a level 1 to a level 3 (low, middle, high) are provided. The level 3 is the highest in accuracy (reliability). For example, in the case where a paper has been subjected only to measurement one time and has not an actual record that printing has been performed by using the paper characteristic data group of this paper, the accuracy index of the paper is classified in the level 1 (low). Moreover, in the case where a paper characteristic data group is obtained by using data obtained by measuring one sheet of paper or multiple sheets of paper multiple times and by subjecting the measured data to averaging processing, the obtained paper characteristic data group is classified into the level 3 (high).

Moreover, the level of a paper characteristic data group may be renewed correspondingly to a subsequent situation, without being fixed by keeping the level at the time of being initially provided. For example, according to a period from the measurement date and time to the present time (at the time of starting printing), the level may be renewed. In this case, in the case where a predetermined period or more has been elapsed, the level is lowered down by one rank. Moreover, in the case where a control parameter has been determined by using a certain paper characteristic data group and printing has been performed on the basis of this control parameter, the rank is renewed according to the results of this printing. For example, the level is made to change depending on the values of the jam occurrence rate per the number of printed papers (or the number of papers having not caused jam consecutively). In the case where a jam occurrence rate is a threshold or more, the rank is made down, and in the case where the number of paper having not caused jam consecutively is a threshold or more, the rank is raised up. The jam occurrence rate used for this determination can be calculated by performing statistical analysis (statistical work). Moreover, in the case where a scanner is disposed on a conveyance passage or conveyance path of an image forming apparatus and is configured to read out a printed image, conveyance precision and image stability can be evaluated by measuring conveyance precision of a paper (slanted conveyance and image position displacement) and image density variation and by conducting statistical analysis for these measurement values. The level may be renewed depending on this evaluation result. In this connection, the rank is not limited to three stages and may be classified into two stages or four stages or more.

The processor 11 compares the accuracy indexes provided as mentioned in the above ways, and in the case where the accuracy index of the first paper characteristic data group exceeds the accuracy index of the second paper specifying data group, the processor 11 uses the first paper characteristic data group, otherwise, the processor 11 uses the second paper characteristic data group.

(Steps S217 and S218)

Here, the processor 11 determines the control parameters by using the paper characteristic data group selected in the previous processing and starts image formation and conveyance on the basis of the determined control parameters. The processing in here is the same as that in Steps S206 and S207 shown in FIG. 8.

In this way, in the second embodiment, while the similar effect to that in the first embodiment is acquired, furthermore, by using the accuracy index provided to the paper characteristic data group, measurement results (paper characteristics) with a high possibility of having measured correctly become to be used. Accordingly, a suitable control parameter can be set more accurately, whereby it is possible to obtain an output with a high quality.

Moreover, in the second embodiment, a result of comparison between the paper characteristics that indicate the surface state of a paper, in the case where a difference between them is larger than a predetermined range, the large difference suggests a possibility of a mistake on obverse and reverse surfaces. Accordingly, a notice to urge to confirm the obverse and reverse surfaces is issued. With this, when papers are loaded in a paper feed tray, even in the case of having made a mistake on obverse and reverse surfaces, it is possible to prevent printing from being executed in the state of having made the mistake.

Printing Processing in Third Embodiment

Figure 13:
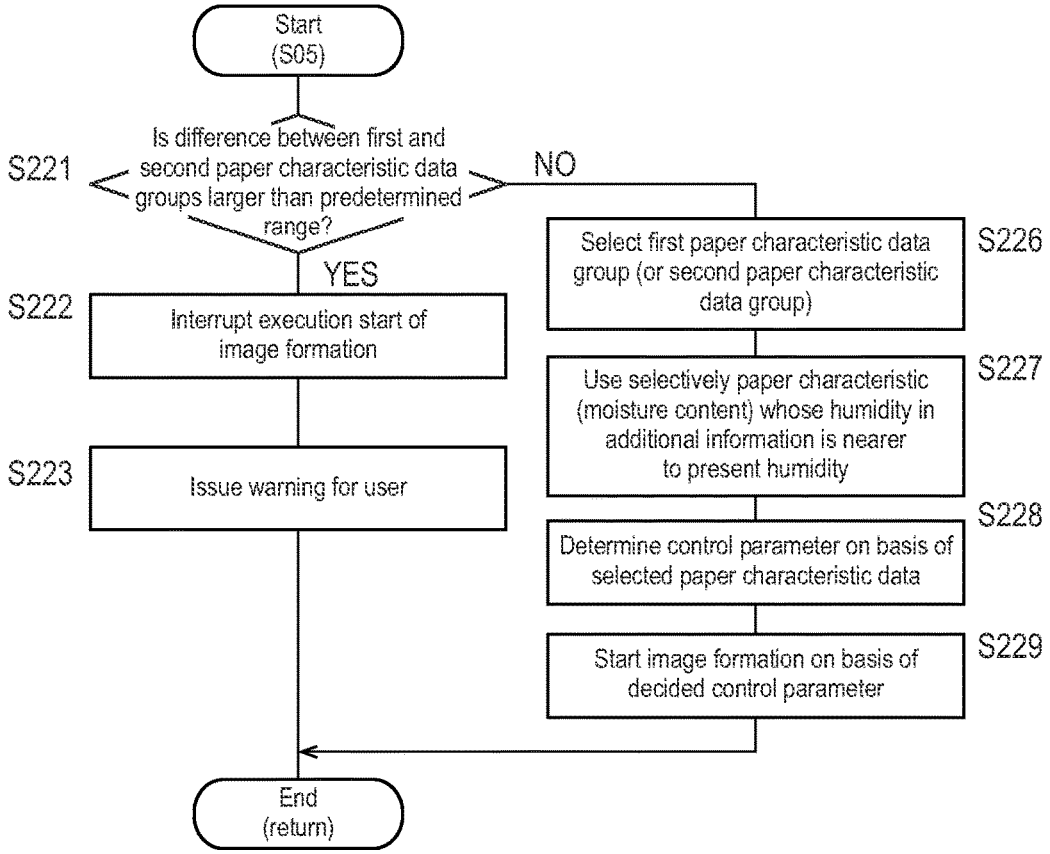
FIG. 13 is a subroutine flowchart showing changing processing (Step S05) of a control operation in the third embodiment.

FIG. 13 is a subroutine flowchart showing changing processing (Step S05) of a control operation in printing processing in the third embodiment. Also, in the third embodiment, the processing other than the processing shown in the above drawing (FIG. 13), is the same as the first embodiment. Accordingly, the description for the processing is omitted. In the printing processing in the third embodiment described below, among a plurality of paper characteristics included in a paper characteristic data group, with regard to a paper characteristic in which a state of a paper changes depending on an environment condition, the paper characteristics is selectively used. As an example of "environment-dependent paper characteristic" with which a state of a paper changes depending on environment conditions, there is a moisture content of a paper. This moisture content is influenced by a humidity of the environment under which a paper is placed.

(Steps S221 to S223)

Here, correspondingly to a difference among the paper characteristic data groups, the start of image formation is interrupted, and a user is notified of warning. The processing in these Steps S221 to S223 is the same as that in Steps S201 to S203 in FIG. 8.

(Step S226)

Here, by the processing similar to that in the preceding stage of Step S206, it is selected whether to use which one of the first and second paper characteristic data groups. This selection is performed in accordance with the rule determined similarly to Step S206. Here, as an example, description is given on an assumption that the first paper characteristic data group has been selected.

(Step S227)

The processor 11 acquires the environment information at the time of image formation, i.e., the environment information of the image forming apparatus 1 at the present time and the environment information at the time of measuring the additional information of each of the first and second paper characteristic data groups. The environment information at the present time is acquired from the temperature and humidity sensor 19 existing in the image forming apparatus 1. As the environment information, humidity data or temperature and humidity data is used. As the environment information at the time of measuring the additional information of the first and second paper characteristic data groups, in the case of using the sensor unit 18 in the apparatus, the measurement values of the temperature and humidity sensor 19 of the apparatus are used and recorded. When using the external sensor unit 80, for example, the measurement values of a temperature and humidity sensor disposed in the sensor unit 80 may be used. Alternatively, it may be permissible to acquire temperature and humidity data from an apparatus (the image forming apparatus 1 or a PC terminal (personal computer)) connected to the sensor unit 80 and to record this temperature and humidity data as additional information of the paper characteristic data group.

Successively, the processor 11 uses selectively, among the first and second paper characteristic data groups, an environment-dependent paper characteristic of one paper characteristic data group whose humidity of the additional information is nearer to the humidity at the present time. For example, in Step S226, when the first paper characteristic data group has been selected, in the case where the humidity of the additional information of the second paper characteristic data group is nearer to the humidity at the present time, as the environment-dependent paper characteristic, i.e., as only the measurement value of the moisture content, the measurement value of the moisture content of the second paper characteristic data group is used, and the measurement value of the moisture content is replaced to that of the first paper characteristic data group. With regard to the other paper characteristics, the paper characteristics of the first paper characteristics are used as they are.

(Step S228)

The processor 11 determines control parameters on the basis of the plurality of paper characteristics selected in Steps S226 and S227. For example, the selected paper characteristics are the first paper characteristic data group or a data group in which, from this first paper characteristic data group, only the paper characteristic of the moisture content is replaced with the measurement result of the paper characteristics of the second paper characteristic data group.

(Step S229)

The processor 11 starts image formation and conveyance on the basis of the control parameters determined in Step S228 and ends the flowchart of the subroutine (returns to the processing in FIG. 6 and ends).

In this way, in the third embodiment, the determination of control parameters is performed by using the environment-dependent paper characteristic of a paper characteristic data group associated with the environment information nearer to the environment information at the time of image formation among the first and second paper characteristic data groups. With this, with regard to the environment-dependent paper characteristic, since the paper characteristics having been measured in the environment nearer to the environment information at the time of image formation, is used, it is possible to use the more exact paper characteristics matching to the state of a paper at the time of image formation. Accordingly, it is possible to prevent deterioration of a print quality before anything happens.

In this connection, in the third embodiment, shown is an example in which among a plurality of paper characteristic of the paper characteristic data group having been selected firstly, only the environment-dependent paper characteristic, i.e., only the measurement value of a moisture content is replaced with the paper characteristic of the other paper characteristic data group. However, the entire paper characteristic data group may be replaced. For example, in the above-mentioned Step S227, not only the paper characteristics of the moisture content but also other paper characteristics are collectively replaced with the measurement values of the second paper characteristic data group.

(Management of Paper Characteristic Data Group by Using File Server)

Figure 14:
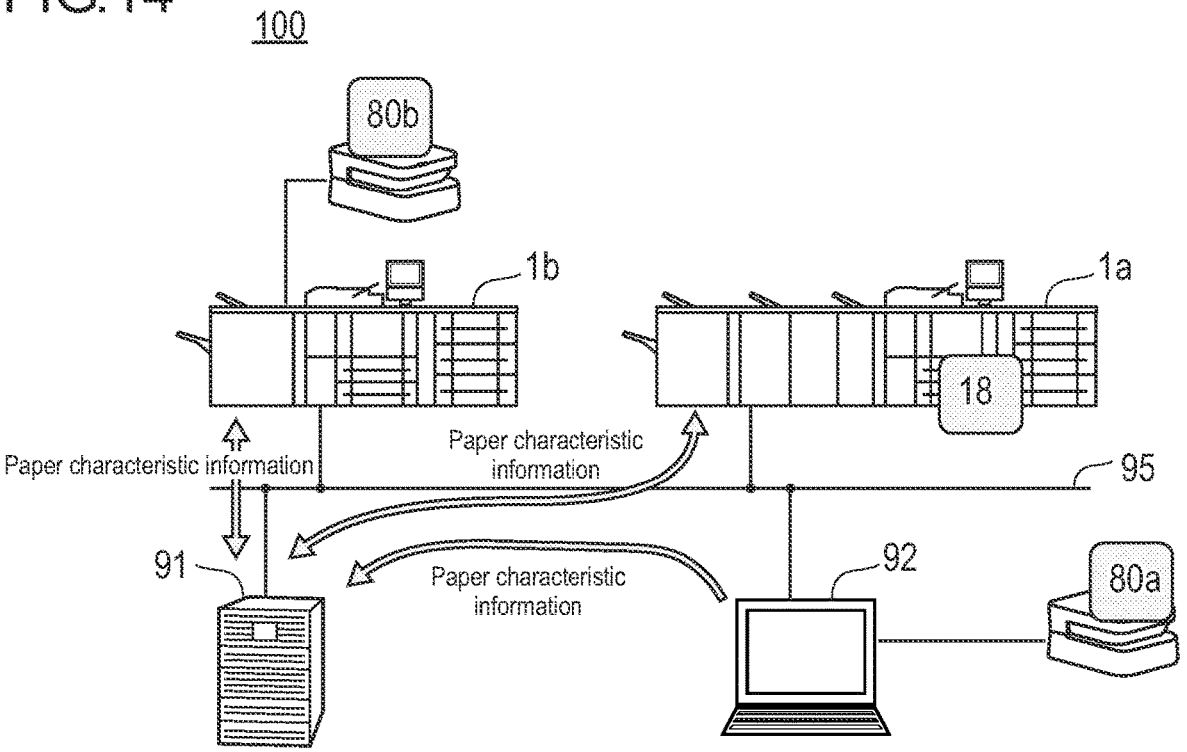
FIG. 14 is a drawing showing a schematic configuration of an image forming system in which a plurality of image forming apparatuses and a plurality of sensor units are connected to a network.

FIG. 14 is a drawing showing a schematic configuration of an image forming system 100 in which a plurality of image forming apparatuses and a plurality of sensor units are connected to a network. As shown in FIG. 14, to a network 95, a file server 91 as a storage device, a PC 92, and image forming apparatuses 1*a* and 1*b* are connected. In this connection, as the storage device, in place of the file server 91, a portable type recording medium, such as a USB memory and a portable HDD may be used. In this case, any one of the image forming apparatuses bears a function as a server and mediates data through the network.

With reference to FIG. 14, in the image forming apparatus 1*a*, the sensor unit 18 is disposed (built-in) in the apparatus (in-line). In the image forming apparatus 1*b*, the external (off-line) sensor unit 80*b* is cable-connected by a USB and the like. The sensor unit 80*a* is connected to the PC92 by a cable. To the file server 91, paper characteristic data groups measured by respective sensor units are transmitted from the PC 92 and the image forming apparatuses 1*a* and 1*b* and memorized. The memorized paper characteristic data groups are mutually used by the respective image forming apparatuses 1*a* and 1*b*. In this connection, the configuration of the image forming system 100 shown in FIG. 14 is merely an example, and image forming apparatuses and sensor units more than the example shown in FIG. 14 may be connected.

Moreover, as shown in FIG. 2, both the in-line sensor unit 18 and the off-line sensor unit 80 may be connected to one image forming apparatus 1.

(Printing Process in Production Print)

Figure 15:
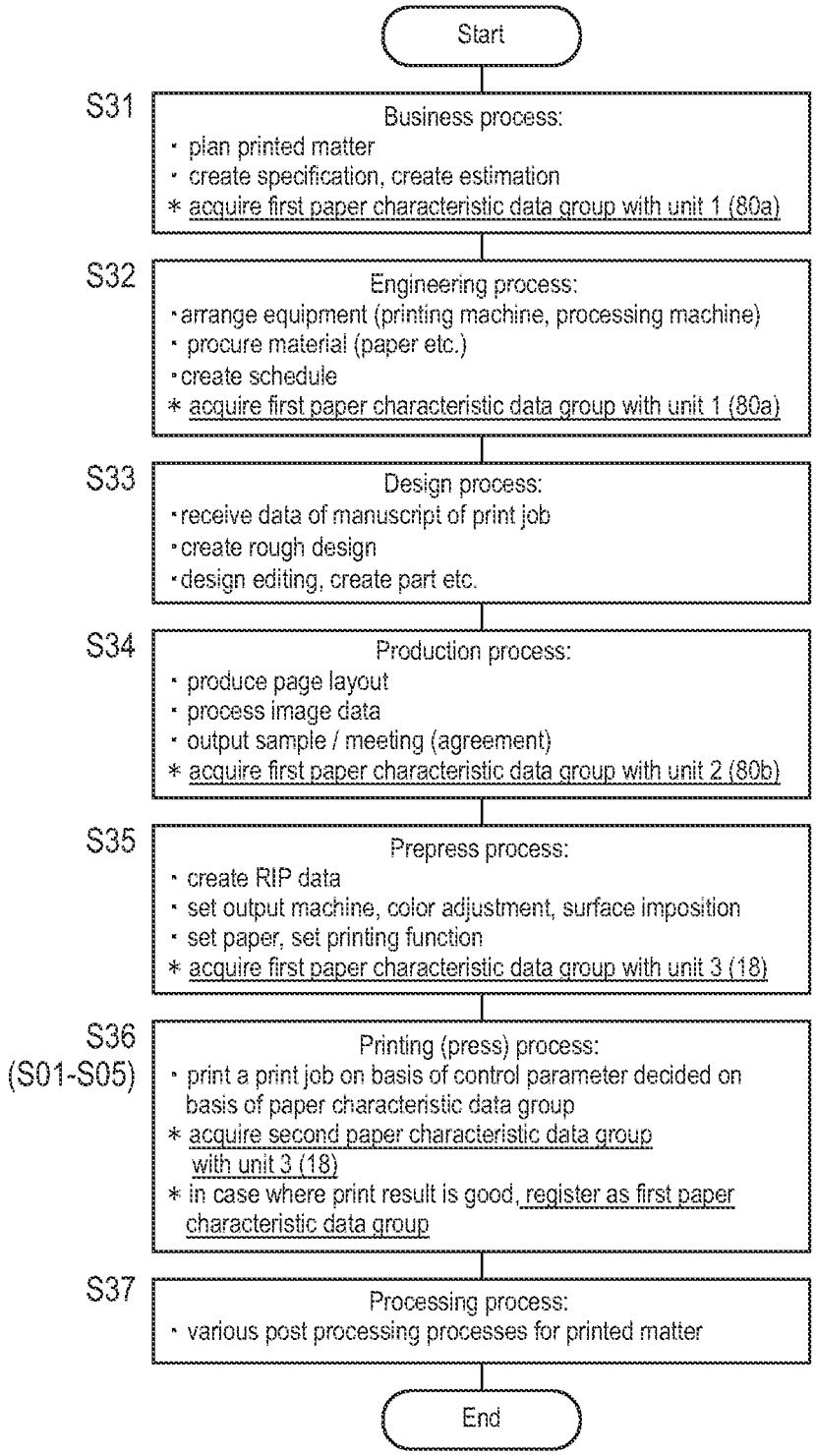
FIG. 15 is a flowchart showing printing processes in a production print.

FIG. 15 is a flowchart showing the printing process in a production print. Hereinafter, with reference to FIG. 14 and FIG. 15, how to acquire the first paper characteristic data group of the first time period at what kind of timing will be described.

(Step S31: Business Process)

As shown in FIG. 15, in Step S31, printed matter is planned, and specification formulation and estimation are created. Generally, at a time when an order of printing processing is received from a client, a paper used for the printed matter is determined. At this time, in the case of using a paper brought in from a client, the received paper is subjected to measurement by a unit 1 (sensor unit 80*a*) connected to the PC 92, and a paper characteristic data group obtained by the measurement is provided with an ID and additional information as the first paper characteristic data group (refer to FIG. 9 and the like) and is memorized in the file server 91.

(Step S32: Engineering Process)

In this step S32, arrangement and security of equipment (a printing machine, a processing machine, and the like) are performed. In the case where there is no stock of designated papers, determined in Step S31, by a client, an order is placed, thereby arranging the designated papers. In the case where the arranged paper has been supplied, at the time of performing acceptance inspection for the supplied paper and storing it, the supplied paper is subjected to measurement by using a unit 1 (sensor unit 80*a*), and then, a paper characteristic data group obtained by the measurement is provided with an ID and additional information and memorized as a first paper characteristic data group in the file server 91.

(Step S33: Design Process)

In here, data submission is performed to a data creation terminal (PC 92 etc.), and then, rough design creation, edit design, part creation, etc. are performed.

(Step S34: Production Process)

On the basis of the rough design, a final page layout is produced, and then, image data processing is performed. Sample printing is performed for a confirming with a client. At the time of this sample printing, when adjusting the setting of an apparatus (automatic adjustment with a scanner in the apparatus etc.), a paper is subjected to measurement by using a unit 2 (sensor unit 80*b*). Successively, a paper characteristic data group obtained by this measurement is provided with an ID and additional information as a first paper characteristic data group and memorized in the file server 91.

(Step S35: Prepress)

In here, RIP data (raster data) is created. At this time, the setting of the image forming apparatus (for example, image forming apparatus 1*a*) for performing actual printing, color adjustment, and imposition of page data in printing are performed. Moreover, paper setting and setting of a print function are also performed. At the time of setting these conditions in an image forming apparatus 1*a* used for this actual printing, a paper is subjected to measurement by a unit 3 (sensor unit 18). Successively, a paper characteristic data group obtained by measurement is provided with an ID and additional information and is memorized in the file server 91.

(Step S36: Printing (Press) Process)

In here, actual printing is performed. The processing of this actual printing corresponds to the printing processing (Steps S01 to S05) shown in from FIG. 6 to FIG. 8. In the case where a print job was able to be executed satisfactorily in the actual printing, in order to make it possible to reuse the paper characteristic data group at the time of executing the next (future) print job expected to use the same paper, information is memorized in the file server 91. At this time, the processor 11 may renew the accuracy index.

(Step S37: Processing Process)

For the printed matters produced by the actual printing, various kinds of post-processing processes are executed.

In this way, in the business of the production print, there are so many first time periods in which the first paper characteristic data group is measured, in various scenes. In the preparatory stage of the execution start of a reserved job, a user loads papers expected to be used, in a paper feed tray. In addition, the user correlates the paper setting of this paper feed tray with the first paper characteristic data group acquired at any one of above-mentioned timings. The second time period is at the time of execution start of a print job after the first time period, or at the time immediately before execution start.

The configuration of the image forming apparatus and sensor described in the above has been merely used to describe a main configuration in order to describe the features of the above-described embodiments. Accordingly, without being limited to the above configuration, various modification can be made within the scope of claims. Moreover, it is not intended to exclude a configuration equipped in a general image forming apparatus and sensor unit.

Devices and methods to perform various kinds of processing in the image forming apparatus 1 according to the embodiments mentioned above can be realized by any one of a hardware circuit for exclusive use and a programmed computer. The above-described program, for example, may be provided by a non-transitory computer-readable recording medium, such as a USB memory and DVD (Digital Versatile Disc)-ROM, or may be provided on-line through a network, such as Internet. In this case, the program recorded in the computer-readable recording medium is usually transmitted to and memorized in a memory unit, such as a hard disk. Moreover, the above-mentioned program may be provided as independent application software or may be incorporated in the software of an apparatus as one function of the apparatus.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. An image forming apparatus, comprising:

an image former that forms an image on a recording medium conveyed on a conveyance path; and a processor that controls image formation on the recording medium by:

acquiring, with a sensor, first information on a first paper characteristic of the recording medium without classifying the first information to any paper kind, after acquiring the first information, acquiring, with the sensor, second information on a second paper characteristic of the recording medium without classifying the second information to any paper kind, and determining a parameter for controlling the image formation and conveyance of the recording medium based on a difference between the first information and the second information and controlling the image formation based on the parameter.

2. The image forming apparatus according to claim 1, wherein in a case where the difference is larger than a predetermined range, the processor refrains from executing the image formation or interrupts the image formation under execution.

3. The image forming apparatus according to claim 2, wherein in a case where the difference is larger than a predetermined range, the processor issues warning for a user.

4. The image forming apparatus according to claim 2, wherein the first and second paper characteristics each indicate a surface state of a paper, and in a case where a difference between the first and second paper characteristics is larger than a predetermined range, the processor issues a notice to urge a user to confirm obverse and reverse surfaces of the recording medium.

5. The image forming apparatus according to claim 1, wherein in a case where the difference is within a predetermined range, the processor determines the parameter based on the first or second information, and the image former forms the image based on the parameter.

6. The image forming apparatus according to claim 5, wherein each of the first information and the second information includes an index indicating a height of a measurement accuracy, and the processor selects, based on the index, one of the first information and the second information for determining the parameter.

7. The image forming apparatus according to claim 6, wherein the index is calculated by statistical analysis of printing results based on the first or second paper characteristic.

8. The image forming apparatus according to claim 5, wherein each of the first information and the second information is associated with environment information including at least one of temperature and humidity at a time of measurement, the processor compares the environment information at a time of the image formation with the environment information associated with each of the first information and the second information, and the processor determines the parameter using the first or second information that is associated with the environment information nearer to the environment information at the time of the image formation.

9. The image forming apparatus according to claim 1, wherein each of the first information and the second information is associated with environment information including at least one of temperature and humidity at a time of measurement.

10. The image forming apparatus according to claim 9, wherein the first and second paper characteristics include an environment-dependent paper characteristic having a measurement value that changes depending on a value of the environment information, the processor compares the environment information at a time of the image formation with the environment information associated with each of the first information and the second information, and the processor determines the parameter using the environment-dependent paper characteristic of the first or second information that is associated with the environment information nearer to the environment information at the time of the image formation.

11. The image forming apparatus according to claim 1, wherein the sensor acquires the first and second paper characteristics by measuring the recording medium having been conveyed on the conveyance path.

12. The image forming apparatus according to claim 11, wherein the second information is measured by the sensor at a time of forming the image by the image former or at a time period immediately before forming the image by the image former.

13. The image forming apparatus according to claim 1, wherein the sensor:

is connected to an external sensor that obtains the first and second paper characteristics by measuring the recording medium, and acquires the first information and the second information from the external sensor.

14. The image forming apparatus according to claim 1, wherein the sensor:

is connected to an external memory that memorizes the first information and the second information, and acquires the first information and the second information from the memory.

15. The image forming apparatus according to claim 1, wherein the first information and the second information are associated with information on time periods during which the first information and the second information are acquired respectively.

16. A printing method, comprising:

forming an image on a recording medium conveyed on a conveyance path; and controlling image formation on the recording medium by:

acquiring, with a sensor, first information on a first paper characteristic of the recording medium without classifying the first information to any paper kind;

after acquiring the first information, acquiring, with the sensor, second information on a second paper characteristic of the recording medium without classifying the second information to any paper kind; and determining a parameter for controlling the image formation and conveyance of the recording medium based on a difference between the first information and the second information and controlling the image formation based on the parameter.

17. A non-transitory computer-readable recording medium storing a control program that controls an image forming apparatus, the program causing a computer to execute:

forming an image on a recording medium conveyed on a conveyance path; and controlling image information on the recording medium by:

acquiring, with a sensor, first information on a first paper characteristic of the recording medium without classifying the first information to any paper kind, after acquiring the first information, acquiring, with the sensor, second information on a second paper characteristic of the recording medium without classifying the second information to any paper kind, and determining a parameter for controlling the image formation and conveyance of the recording medium based on a difference between the first information and the second information and controlling the image formation based on the parameter.

18. The image forming apparatus according to claim 1, wherein the sensor acquires data of a plurality of characteristics of the recording medium.

19. The image forming apparatus according to claim 1, wherein the processor controls the image formation based on the difference with respect to at least one of the plurality of characteristics.

20. The image forming apparatus according to claim 1, wherein the processor classifies the paper kind based on at least one of the first information and the second information and determines the parameter based on the classified paper kind.

21. The image forming apparatus according to claim 1, wherein the processor directly determines the parameter based on at least one of the first information and the second information without classifying the first information and the second information to any paper kind.

* * * * *